United States Patent [19]

Fortunato

[11] 4,273,339

[45] Jun. 16, 1981

[54] PLASTIC CESTA

[76] Inventor: Gilbert J. Fortunato, 23 Blinn St., East Hartford, Conn. 06108

[21] Appl. No.: 33,420

[22] Filed: Apr. 26, 1979

[51] Int. Cl.[3] ..... A63B 65/12

[52] U.S. Cl. ..... 273/326

[58] Field of Search ..... 273/96 R, 67 R, 326; 124/5

[56] References Cited

U.S. PATENT DOCUMENTS

| | | | |
|---|---|---|---|
| 642,638 | 2/1900 | Smith | 273/96 R |
| 1,177,116 | 3/1916 | Lackland | 273/96 R |
| 4,098,508 | 7/1978 | Gandy | 273/96 R |

*Primary Examiner*—Peter Chin

*Attorney, Agent, or Firm*—McCormick, Paulding & Huber

[57] ABSTRACT

A molded plastic cesta is formed with all but the glove portion defined by a single integrally molded plastic part or body portion, the pilota launching surface of which is generally straight and integrally connected to an arcuate inner ramp surface which is integrally connected to a second straight segment oriented perpendicular to the first or launching surface. This second straight surface segment receives the glove defining portion. A reversely curved surface also integrally connected to these surfaces defines a pocket for the pilota. The cross sectional configuration defines a chute of varying depth, the deepest portion provided at the pocket, and the opposite end portions of the cesta defining relatively shallow chute-like segments. The outer marginal edge portions of the chute side portions define outwardly turned flanges for receiving a reinforcing plastic slide-strip adapted to fit over these flanged portions, not only to strengthen them, but also to reduce the likelihood of injury in the event that the rapidly swung cesta comes in contact with a teammate or an opposing player. The glove defining portion may be fabricated from a vinyl cloth material in two layers, which layers are folded back one top of the other such that they can be stitched together to form finger openings, and the upper layer extends downwardly beyond the lower layer to permit a cestus or strap to be wound around the users wrist and also around a peg slidably received in a laterally extending bore defined for this purpose in a bracket element rivited to the inner end of the plastic cesta.

4 Claims, 6 Drawing Figures

PLASTIC CESTA

SUMMARY OF THE INVENTION

This invention relates generally to hand held devices for throwing or projecting a small hard ball such as a pilota of the type commonly used in JAI LAI Frontons. More particularly, the plastic cesta is integrally molded from a one-piece polystyrene material and provided with a unique shape so as to withstand the considerable force exerted upon it in throwing or catching the pilota or other ball with which the cesta is used.

In carrying out the present invention the plastic cesta is preferably molded to have a body portion which defines a chute having a generally straight launching surface segment adjacent its outer end and integrally connected arcuate inner end surface tangentially arranged such that the arcuate surface has a radius of curvature which decreases in magnitude along the inwardly curved ramp surface of the chute. The innermost end of the body portion also defines a generally straight segment connected to the inner end of the arcuate ramp surface by a reversely curved portion and these straight inner and outer segments are generally perpendicular to one another. The body portion and more particularly the chute defining portion thereof also has generally parallel cresent shaped sides also integrally connected to the ramp surface and so defining the U-shaped chute that a pocket is provided in the area of sharpest curvature to receive the pilota and to retain it for throwing. A flexible member is attached to the surface of the flat inner segment of the cesta, generally opposite the ramp or launching surface thereof, and this flexible member is preferably formed from two layers of resilient material stitched at appropriate areas to define a glove for the users hand. Means is provided for winding a strap or cestus around the glove-like portion and around a pin slidably received in a metal bracket located at the innermost end of the plastic cesta.

Whereas prior art devices for use in JAI ALAI frontons have been fabricated from a wicker material and have been very expensive to produce due to the extensive labor required, the plastic cesta described herein provides many advantages over this conventional cesta construction. First, a high degree of consistency can be obtained in the manufacturing process, and secondly the resulting product is considerably less expensive than the hand made cesta.

DETAILED DESCRIPTION

Figure 1:
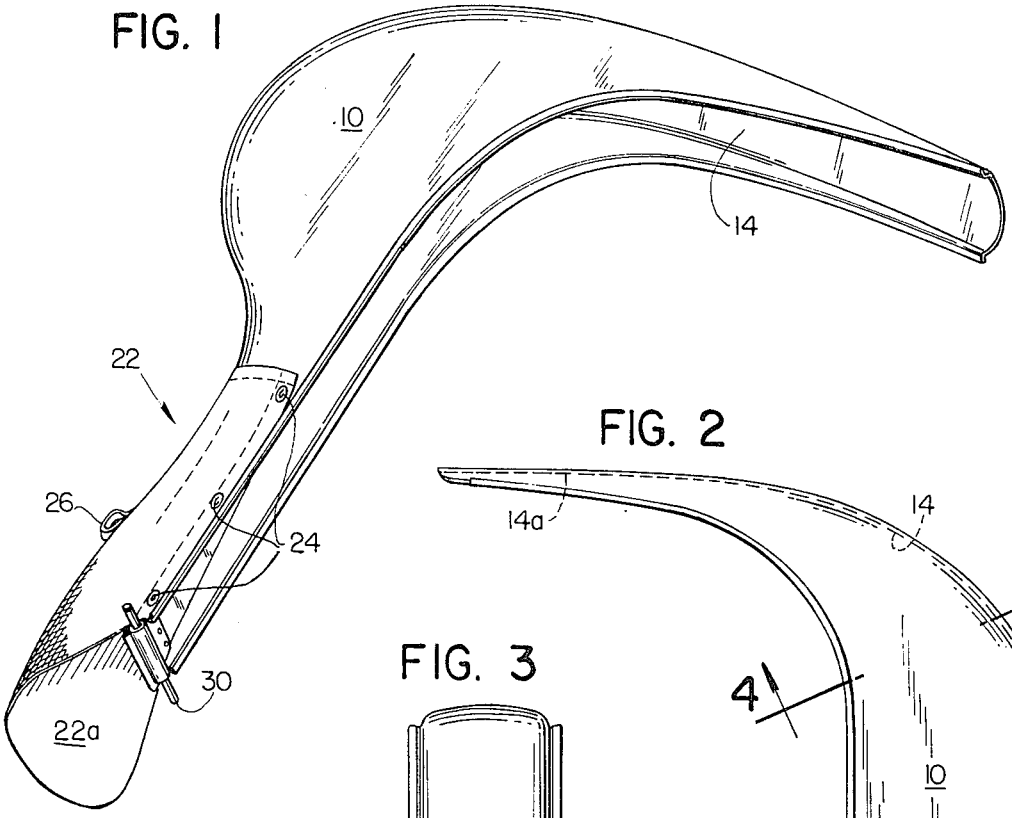
FIG. 1 is a perspective view of a plastic cesta constructed in accordance with the present invention.
Figure 2:
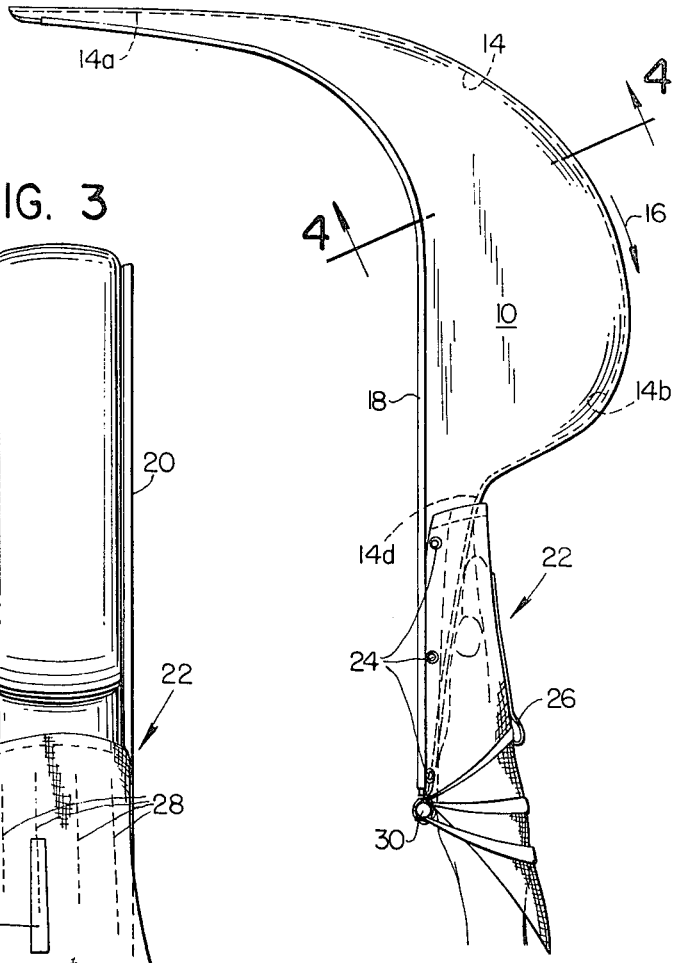
FIG. 2 is a side elevational view of the cesta shown in FIG. 1 lashed to the hand of the user.
Figure 4:
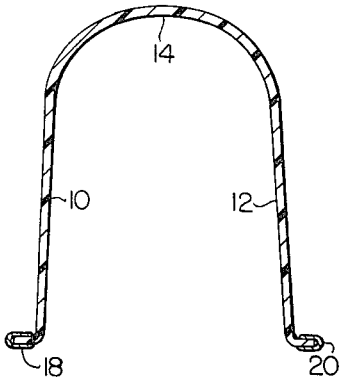
FIG. 4 is a sectional view taken generally on the line 4—4 of FIG. 2.
Figure 5:
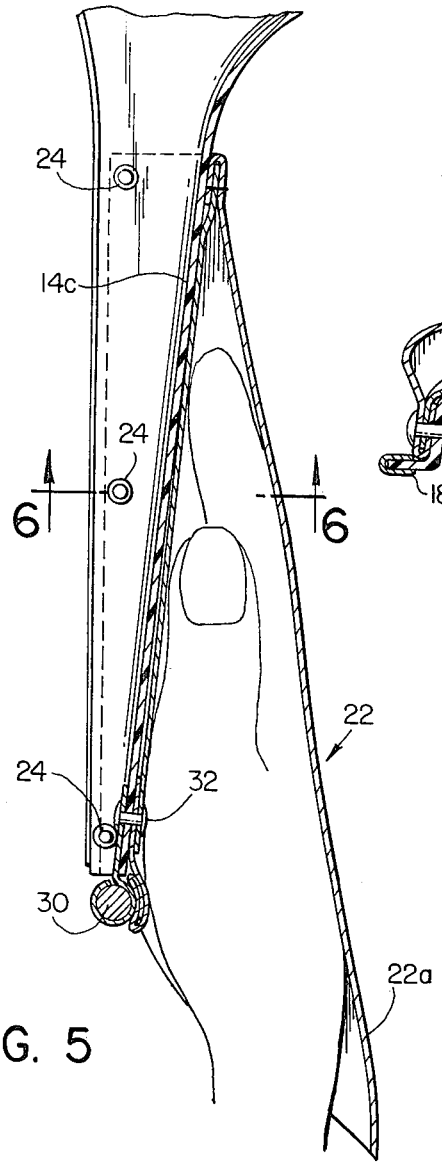
FIG. 5 is a detailed view illustrating the portion of the cesta to which the glove defining element is attached and also illustrating the hand of the user to a slightly larger scale than shown in FIG. 2.
Figure 6:
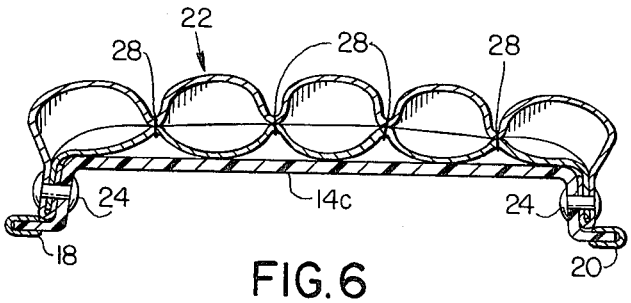
FIG. 6 is a sectional view through the inner hand held end of the plastic cesta as shown by the lines 6—6 on FIG. 5.

Turning now to the drawings in greater detail, FIG. 1 shows a cesta molded from a single sheet of thermoplastic material, such as polystyrene, and to which plastic cesta a glove like element is added for convenience in gripping the inner or lower end portion thereof. The plastic cesta comprises a one-piece molded portion which defines a chute as illustrated in FIG. 4, the chute having side walls 10 and 12 integrally connected to one another by a ramp surface 14 which ramp surface is curved throughout the major portion of its length but has a straight outer end portion **14*a* for launching the pilota (not shown). The arcuate inner ramp surface is connected to, and tangent to the straight surface 14*a*, and as best shown in FIG. 2 has a radius of curvature which decreases in magnitude along the direction of the arrow 16 so that the innermost end of this arcuate ramp portion of decreasing radius defines a pocket 14*b*. The pocket permits the pilota to be conveniently caught, or held preparatory to throwing it during the contest. As best shown in FIG. 5 the inner ramp surface of the cesta also has a straight segment 14*c* connected to the inner end of said decreasing radius portion by a reversely curved portion best shown at 14*d* in FIG. 2. The inner straight segment is generally perpendicular to the outer launching surface 14*a* and the sides of the cesta are generally crescent shaped, and integrally connected to the ramp surface, to define a U-shaped chute having the above described pocket in the area of sharpest curvature, and all of these portions of the cesta are formed integrally with one another in a single molding step preferably in a vacuum forming process starting with a sheet of polystyrene material, or the equivalent, of approximately one-eighth of an inch in thickness. The crescent shaped sides of the cesta body portion are preferably turned outwardly to form flanges, as best shown in FIG. 4, and also in the area of the cesta to which the glove like element is attached as best shown in FIG. 6. These outwardly turned flanged portions of the crescent shaped sides 10 and 12** are fitted with U-shaped protective strips of vinyl material or the equivalent. These strips preferably extend from a point adjacent the inner end of the cesta to a point adjacent to the outer end of the cesta and may be cemented in place in order to avoid the sharp edges otherwise encountered as a result of the outwardly turned flanges on the crescent shaped sides of the polystyrene cesta itself.

Figure 3:
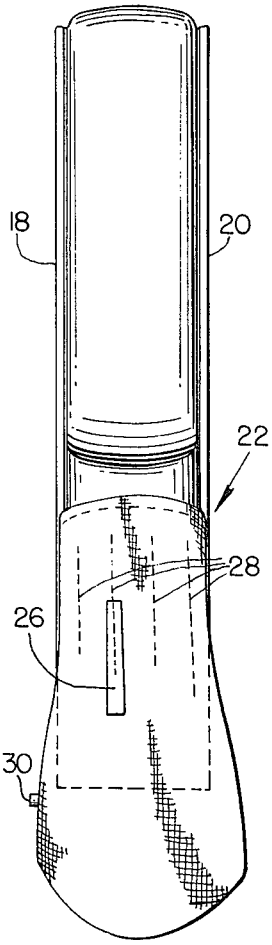
FIG. 3 is a rear elevational view of the plastic cesta shown in FIG. 2.

The glove defining element is shown at 22 in FIG. 1 and preferably comprises a vinyl covered cloth material folded back upon itself to provide two layers which are riveted or otherwise attached to the plastic cesta as shown at 24, that is along the lateral edges thereof. The outer layer is preferably somewhat longer than the inner layer, as illustrated in FIGS. 1 and 3, with the outer layer also defining a loop 26 in order to receive a cord or cestus for convenience in strapping the cesta to the hand of the wearer as best shown in FIG. 2. The two layers of the glove defining element are preferably stitched in selected areas, as best shown in FIG. 3 at 28, in order to provide openings, best shown in FIG. 6, for receiving the fingers of the wearer. A metal bracket is preferably riveted to the inner end of the ramp surface adjacent to the this glove defining element as best shown in FIG. 5 in order to define an opening or bore for receiving a rod 30 such that the cord or cestus can be conveniently wound around this rod and around the wearer's wrist over the flap portion **22*a* in the process of securing the cesta to the wearer's arm or wrist. The metal bracket element 30 is preferably riveted as shown in FIG. 5 at 32 and formed from an initially flat stock which is bent to define the opening for receiving the rod or cylinder 30**.

I claim:

1. A molded plastic cesta for throwing or catching an object such as a ball, said cesta comprising a body portion defining a chute having a generally straight launching surface segment adjacent one end and an arcuate inner ramp surface connected to said straight surface and tangent therewith, said arcuate inner surface having a radius of curvature which decreases in magnitude along the inwardly curved surface, and an inner end of said body portion defining a generally straight segment connected to the inner end of said decreasing radius portion of sharpest curvature by a reversedly curved portion such that the said straight inner and outer segments are generally perpendicular to one another, said body portion having generally parallel crescent shaped sides integrally connected to said ramp surface to define a U-shaped chute having a pocket in the area of sharpest curvature, and a glove defining flexible member attached to the surface of said flat inner segment opposite the ramp surface thereof, said body portion having a uniform thickness, being formed from a single plastic member and having outturned flanged portions integrally formed in said sides, which flanged portions have the same thickness as said sides, and stiffeners for said flanged portions, said stiffeners being made from U-shaped plastic strips slidably received on said outturned flanged portions, a cestus for securing the cesta to the wrist, metal bracket means secured to the innermost end portion of the plastic cesta ramp surface and defining an elongated opening transverse to the chute, and a peg for said opening, said peg having end portions projecting beyond the sides of said bracket to facilitate girdling the cestus onto the wearer's wrist.

2. A molded plastic cesta for throwing or catching an object such as a ball, said cesta comprising a body portion defining a chute having a generally straight launching surface segment adjacent one end and an arcuate inner ramp surface connected to said straight surface and tangent therewith, said arcuate inner surface having a radius of curvature which decreases in magnitude along the inwardly curved surface, and an inner end of said body portion defining a generally straight segment connected to the inner end of said decreasing radius portion of sharpest curvature by a reversedly curved portion such that the said straight inner and outer segments are generally perpendicular to one another, said body portion having generally parallel crescent shaped sides integrally connected to said ramp surface to define a U-shaped chute having a pocket in the area of sharpest curvature, and a glove defining flexible member attached to the surface of said flat inner segment opposite the ramp surface thereof, said body portion having a uniform thickness, being formed from a single plastic member and having outturned flanged portions integrally formed in said sides, which flanged portions have the same thickness at said sides, and stiffeners for said flanged portions, said stiffeners being made from U-shaped plastic strips slidably received on said outturned flanged portions, said inner straight segment having integral shallow sides formed as continuations of the crescent shape sides, and wherein said glove defining member comprises at least two generally rectangular cloth layers attached along their longer marginal edges to said shallow sides, said layers stitched at selected areas to provide finger openings for the hand, a cestus for securing the cesta to the wrist, metal bracket means secured to the innermost end portion of the plastic cesta ramp surface and defining an elongated opening transverse to the chute, and a peg for said opening said peg having end portions projecting beyond the sides of said bracket to facilitate girdling the cestus onto the wearer's wrist said bracket means secured to said plastic cesta ramp surface by attachment means also serving to attach portions of said cloth layers so that said metal bracket does not contact the wrist or hand of the wearer.

3. The cesta of claim 2 wherein the outermost layer of said at least two layers has a flap to protect the back of the wearer's hand from chafing by the cestus.

4. The cesta of claim 3 wherein one end of the cestus is secured to said outermost layer by tying, said outermost layer defining a loop for receiving said one end thereof.

* * * * *